United States Patent [19]

Christie

[11] Patent Number: 4,880,651

[45] Date of Patent: Nov. 14, 1989

[54] METHOD OF AND APPARATUS FOR PRODUCING INFUSIBLE BAG HOLDERS

[76] Inventor: Hugh P. Christie, 50 Bevington Rd., Glenunga 5064, Australia

[21] Appl. No.: 171,000

[22] PCT Filed: May 12, 1987

[86] PCT No.: PCT/AU87/00134

§ 371 Date: Jan. 14, 1988

§ 102(e) Date: Jan. 14, 1988

[87] PCT Pub. No.: WO87/06913

PCT Pub. Date: Nov. 19, 1987

[30] Foreign Application Priority Data

May 15, 1986 [AU] Australia ..... PH05919

[51] Int. Cl.[4] ..... B65B 29/04

[52] U.S. Cl. ..... 426/394; 53/413; 53/462; 53/466

[58] Field of Search ..... 426/77–84, 426/394; 53/413, 397, 466, 134, 580, 120, 462

[56] References Cited

U.S. PATENT DOCUMENTS

| | | | |
|---|---|---|---|
| 870,501 | 11/1907 | Farnham | 53/120 |
| 2,192,605 | 3/1940 | Salfisberg | 53/413 |
| 2,614,934 | 10/1952 | Trotman | 426/83 |
| 2,728,672 | 12/1955 | Young et al. | 426/77 |
| 2,899,045 | 8/1959 | Irmscher | 426/83 |
| 3,053,665 | 9/1962 | Irmscher | 426/83 |
| 3,223,229 | 12/1965 | Welin-Berger | 426/83 |
| 3,439,469 | 4/1969 | Van Mil | 53/120 |
| 3,566,573 | 3/1971 | Irmscher | 426/77 |
| 3,895,118 | 7/1975 | Rambold | 426/83 |
| 3,977,152 | 8/1976 | Rochla et al. | 53/120 |
| 4,021,993 | 5/1977 | Widmer | 53/120 |
| 4,055,668 | 10/1977 | Kopp | 426/83 |
| 4,084,391 | 4/1978 | Williams et al. | 53/120 |

*Primary Examiner*—Steven Weinstein

*Attorney, Agent, or Firm*—Bruce L. Adams; Van C. Wilks

[57] ABSTRACT

Method and apparatus to provide a tea bag with a cover. The tea bags (1) slide (2) onto a length of cover material (3) where they are attached at one edge only, using heat sealing, etc. (7). The cover material is creased (5, 9) and cut (13), the rollers (10, 11) serving to forward it and the bags attached thereto. Blade (15) pushes the creaseline of a cover so that bag and cover are forced between rollers (16, 17) to fold the cover about its bag. In an alternative, blade (15) pushes each bag and cover between two spring steel plates whereby the pressing of the plates folds the cover about its bag.

13 Claims, 2 Drawing Sheets

METHOD OF AND APPARATUS FOR PRODUCING INFUSIBLE BAG HOLDERS

This invention relates to a method of and apparatus for producing and attaching holders/covers to bags containing infusible products.

BACKGROUND OF THE INVENTION

In my earlier Patent Application PCT/AU85/00279 there is disclosed a tea bag and cover, the cover comprising two leaves about a fold line, said tea bag being attached by attachment means to one leaf adjacent said fold line whereby said fold line is above said attachment means to enable the leaves to fold to one side of the bag with no part of either leaf being on the cup side of the bag when suspended in a cup by inserting the bag inside the cup with one leaf passing down the outside of the cup.

Also there is disclosed the method of manufacturing a tea bag and cover, the tea bag having a crimped peripheral flange, the method comprising the steps of providing a sheet of paper to form the cover, stapling the tea bag to the sheet of paper at a position below the transverse center line of the sheet, and forming a fold line on the transverse center line of the sheet to form two leaves to overlie the tea bag.

Thus, that invention describes a tea bag and protective cover which will protect the tea bag in packaging and storing, while providing means to support the tea bag in the liquid in the cup without obstructing the opening to the cup, and which can be agitated to improve and speed up infusion and which also can be used for safely withdrawing the tea bag from the cup for squeezing the residue and eventual disposal of the tea bag.

BRIEF SUMMARY OF THE INVENTION

The present invention relates to a method of manufacturing an infusible bag and cover, the method including the steps of feeding the covers, placing and orientating a bag on the cover, attaching the bag to the cover, and creasing the cover across its width in its center adjacent the attachment of the bag to the cover, folding the leaves of the cover over the bag, and stacking the bags for packaging.

Also there is provided an apparatus for producing an infusible bag and cover, the apparatus comprising conveyor means for feeding a cover, means for placing and orientating a bag in position on the cover, means for attaching the bag to the cover, means for creasing the cover across the width of the cover adjacent the attachment of the bag to the cover, means for folding the leaves of the cover over the bag, and means for stacking and packaging the tea bag and cover.

In one form of the invention the cover is preferably a sheet of paper or thin plastics material which can be fed from a reel and cut to the required length, or can be fed from a stack onto a continuous conveyor. The conveyor is provided with spaced lugs, and the cover is positioned with its leading edge against a front lug, the lugs being spaced apart to enable a single cover to be positioned between each lug, the lugs being spaced slightly greater than the length of each of the covers to provide delivery clearance.

The infusible bags or pouches are made in a separate pouch maker and preferably have a crimped flange along at least one edge thereof and are positioned on the leading edge of the cover by use of grippers, suction means, or means to slide the pouch against the front lug, the feeding means and the belt speed being synchronized with the pouch delivery.

The belt then delivers the cover and pouch thereon to a stapling and creasing means, these in one form being a combined unit, to staple and crease the pouch and cover against a mandrel and a groove built into the conveyor web. The stapling and grooving unit can reciprocate at the conveyor web speed and moves downwardly to insert the staple and create the crease in the cover adjacent the attachment point.

Alternatively, the creasing and stapling can be carried out separately, and also other forms of attachment of the pouch to the cover can be utilized. For example the creasing and attachment can be achieved by a heating unit to seal the flange portion of the pouch to the cover there being a slit in the web on the opposite side of the sealing head to form the crease. The unit moves at a velocity which is synchronized with the belt speed.

In other alternatives the pouch can be glued to the cover either by pressure, or supplying heat for the rapid curing of the glue.

While the invention is particularly described with respect to tea bags, it is to be realized that the invention is not to be limited thereto but can include any pouch, bag or package to hold a substance, the bag preferably containing an infusible substance.

In all these examples the attachment means may reciprocate and on its forward movement be synchronized with the belt or web speed or alternatively could be mounted on a rotary unit which again is synchronized with the web speed.

When the pouch is attached to the cover, a blade descends to engage the crease and push the cover and pouch through a slot to be engaged by rollers which draw the pouch and cover through the slot and deliver it into a collator or stacker or the like.

DESCRIPTION OF THE PREFERRED EMBODIMENT

Figure 1:
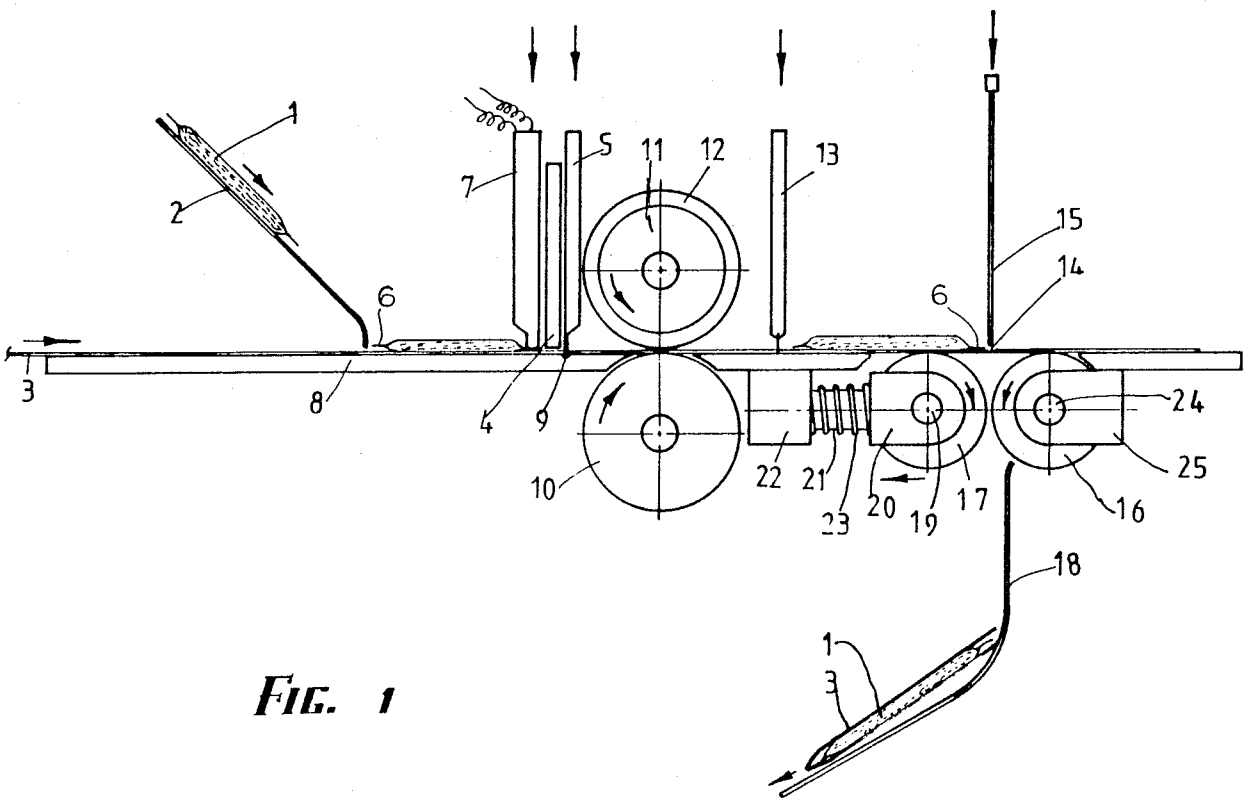
FIG. 1 illustrates in side elevation one form of the invention.

In a preferred form of the invention as shown in the drawings, the bags 1 are fed down a slide 2 onto the cover strip material 3 at a first aork station, the bags being located by a stop 4 which in this embodiment is attached to a creasing blade 5.

The bags 1 have a peripheral flange 6 or marginal edge portion, the flange 6 abutting the stop 4 to thereby position the bags at a predetermined position.

Adjacent the creasing blade 5 at the first work station there is provided an attachment means, in this instance being a heat sealing blade 7. The creasing blade 5 and heat sealing blade 7 are mounted in slides (not shown) and operated by known means, such as pneumatically, hydraulically, mechanically or electromagnetically, the heat sealing blade being controlled by a timer so that the heat sealing blade is held in contact with the flange of the bag the required length of time to achieve the heat sealing.

The heat sealing blade may extend across the whole width of the flange of the bag, but preferably only seals the central portion of the bag, so that the desired curving of the bag can take place when placed on a cup edge as explained in my earlier Patent specification.

Alternatively, instead of the bag being heat sealed to the cover strip, the bag may be stapled thereto, the heat sealing blade being replaced by a stapling head to operate against an anvil beneath the cover strip.

The cover strip 3 slides on a bed 8, the bed 8 having a groove or recess 9 in its upper surface to receive the creasing blade 5, the blade forming a crease and also reducing the thickness of the cover strip at this location to provide a flexible hinge.

The cover strip 3 is preferably fed from a roll (not shown) of the cover strip material, the cover strip 3 and bag being fed along the bed 8 by a pair of feed rollers 10, 11. The upper roller 11 preferably has a central clearance 12 for the passage of the contents of the bag therethrough, the outer flanges of the roller 11 engaging the side flanges of the bag to feed the bag and cover strip along the bed 8.

Situated on the downstream side of the rollers 10, 11 at the first work station there is provided a knife 13 also operating in slides (not shown) to cut the cover strip material to the required length, the knife 13 being operated in a similar manner to the creasing and sealing blades 5 and 7, and in timed relation thereto.

The cover strip with bag attached thereto is fed to a position where it is folded and creased, and the strip is cut, the center of the length of the cover strip, that is the crease being positioned above a slot 14, in the bed 8 and below a displaceable pusher blade 15.

Beneath the bed 8 at a second work station there are positioned a pair of folding and creasing rollers 16, 17, blade 15 pushing the cover strip and bag through the slot 14 a distance sufficient for the rollers to engage the folded cover strip. The rollers thus fold the cover strip into a sharp fold, and as the rollers continue rotation the cover strip and bag are fed down a chute 18 to a packing position.

In order for the rollers to pass over the thickness of the bag, at least one roller, for example roller 17, is mounted in a spring loaded fashion, by having its axle 19 mounted in a fork 20 having a shaft 21 slidable in a boss 22 attached to bed 8, a spring 23 acting between the fork 20 and boss 22 to apply the desired loading to fold the cover strip along the crease and yet allow movement of the roller 17 to allow passage of the bag between the rollers.

Roller 16 is mounted on axle 24 mounted on a fork 25 attached to the bed 8.

In operation the driven feed rollers 10, 11 operate periodically and intermittently, and are so driven to index the cover strip the required distance, the heat sealer, creasing blade, knife and pusher blade all operating in synchronism during the cycle.

Figure 2:
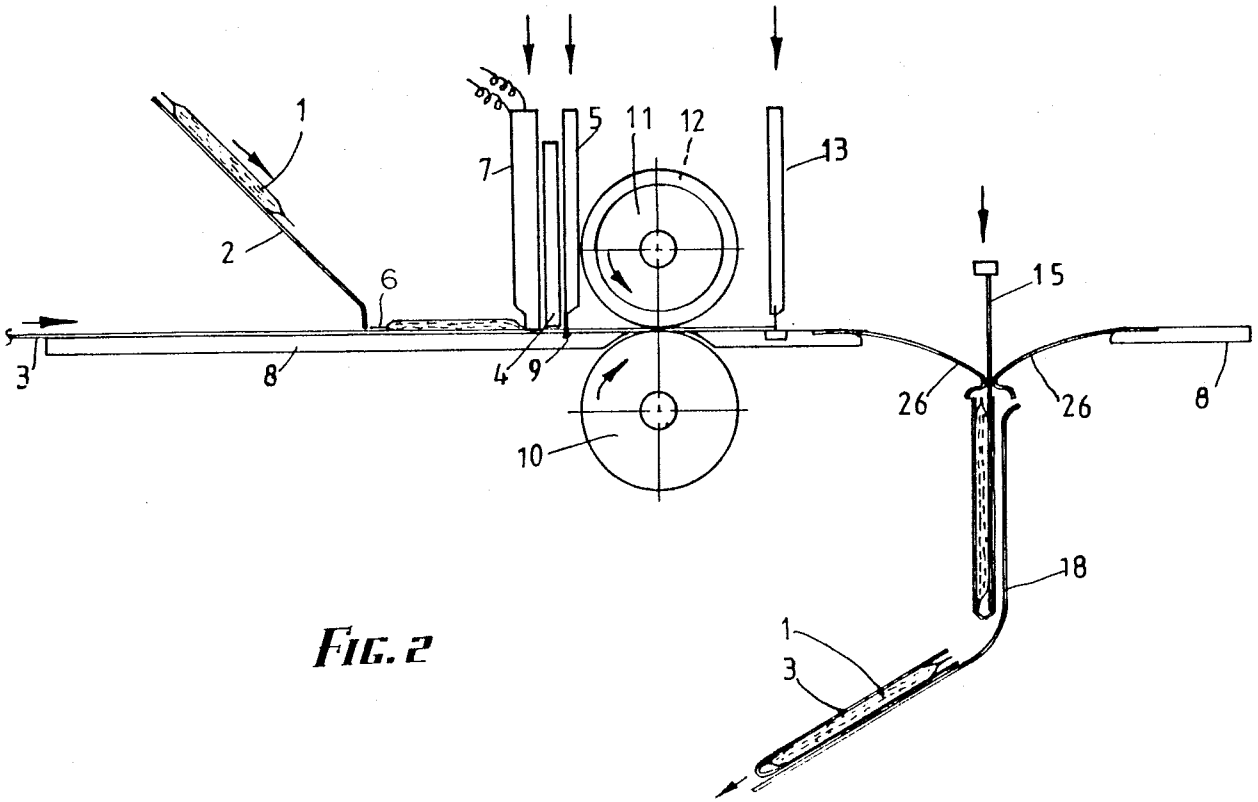
FIG. 2 shows an alternative form of folding the cover.

In an alternative form of the invention as shown in FIG. 2, instead of a pair of creasing and folding rollers beneath the slot 14 there is positioned a pair of opposed spring steel resilient guides 26 attached to the undersurface of the bed 8. Each guide 26 has a curved end, these in the rest position abutting each other. As the blade 15 pushes the cover strip through the guides 26, the pressure exerted by the guides folds the cover strip at the crease to a relatively sharp fold, the guides 26 deflecting as the bag passes therebetween.

Hence the invention resides in the attachment of the bag to the cover strip, and the folding of the cover strip over the bag.

The folding can be as described by folding or pressing, or alternatively, while in the flat condition on the bed, a finger or the like can lift the flap and fold it back on the bed, and then a press member can be applied to the fold line to form the hinge.

The cover strip may be of any suitable material, such as paper, paper board, cardboard, plastics material, or thin foam plastics material. The cover strip material may be in roll form and cut, or be in individual sheets, and also while one process line has been described, there may be a multiple bank of lines feeding from separate rolls, or alternatively from a wide sheet of material which is slit into the strips of the required width before or after processing.

The bags themselves may be of any known type, as long as they have an area for attachment.

The method of attachment may vary, being either heat sealed or stapled as described, or alternatively by ultrasonic welding, stitching, use of adhesives or crimping.

In a further form, the heat sealing blade, creasing blade and knife may, instead of being reciprocated with an intermittent feed of the cover strip and bags, may utilize a continuous strip feed with rotary sealing and creasing blades and a rotary knife. This would result in higher production rates.

Furthermore the steps can be carried out on a rotatable table, indexing the bag and cover strip to successive stations to attach, crease and fold.

Although one form of the invention has been described in some detail, it is to be realized that the invention is not to be limited thereto but can include various improvements and modifications falling within the spirit and scope of the invention.

I claim:

1. A method of attaching a cover to an infusible bag, the method comprising the steps of: providing a cover strip; feeding a water-permeable bag containing an infusible substance onto the cover strip, the bag having opposed sides and a marginal edge; creasing the cover strip to form a fold line; directly attaching the bag along the marginal edge thereof to the cover strip adjacent to but at one side of the fold line of the cover strip such that the entire bag lies to one side of the fold line; and then folding the cover strip to at least substantially cover both sides of the bag.

2. A method as defined in claim 1; wherein the attaching step comprises attaching a marginal edge portion of the bag to the cover strip by heat sealing.

3. A method as defined in claim 1; including the step of pressing the folded-over cover strip at the fold line to form a hinge.

4. A method as defined in claim 1; wherein the attaching step comprises directly attaching the bag to the cover strip at a center portion of said edge of the bag, the outer side portions of said edge being unattached to the cover strip.

5. A method for attaching a cover to an infusible bag, comprising the steps of: feeding a cover strip to a first work station; feeding a water-permeable infusible bag containing an infusible substance onto the cover strip at the first work station; attaching a marginal edge portion of the infusible bag to the cover strip at the first work station; creasing the cover strip, at the first work station, to form a fold line adjacent to but at one side of the point of attachment thereof to the infusible bag such that the entire bag lies to one side of the fold line; advancing the infusible bag with attached and creased cover strip to a second work station; and folding the cover strip along the fold line so that the folded cover strip covers both sides of the infusible bag at the second work station.

6. A method according to claim 5; wherein the step of feeding an infusible bag comprises feeding the infusible bag so that one side of the bag lies on the cover strip.

7. A method according to claim 5; wherein the step of folding comprises pushing a blade member downwardly onto and transversely of the cover strip at the fold line to effect folding of the cover strip along the fold line.

8. A method according to claim 7; including the step of pressing together the folded cover strip at the fold line at the blade member is being pushed down onto the cover strip to form a hinge in the region of the fold line.

9. A method according to claim 8; wherein the step of pressing comprises pressing together the folded cover strip between a pair of rollers.

10. A method according to claim 8; wherein the step of pressing comprises pressing together the folded cover strip between a pair of resilient guide members.

11. A method according to claim 5; wherein the step of feeding a cover strip comprises feeding a length of cover strip to the first work station; and further including the step of cutting the length of cover strip to a desired length at the first work station.

12. A method according to claim 5; wherein the advancing step comprises advancing the infusible bag with attached and creased cover strip by means of a pair of rollers at least one of which is rotationally driven.

13. A method according to claim 5; including periodically repeating the feeding, attaching, creasing, advancing and folding steps in synchronized relation to one another to successively attach covers to successively fed infusible bags.

* * * * *